US007719179B2

(12) United States Patent
Ha

(10) Patent No.: US 7,719,179 B2
(45) Date of Patent: May 18, 2010

(54) ELECTRON EMISSION DISPLAY DEVICE

(75) Inventor: Jae-Sang Ha, Suwon-si (KR)

(73) Assignee: Samsung SDI Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 919 days.

(21) Appl. No.: 11/117,575

(22) Filed: Apr. 29, 2005

(65) Prior Publication Data

US 2005/0245117 A1 Nov. 3, 2005

(30) Foreign Application Priority Data

Apr. 29, 2004 (KR) ..... 10-2004-0029879

(51) Int. Cl.
*H01J 1/62* (2006.01)
*H01J 9/26* (2006.01)

(52) U.S. Cl. ..... 313/496; 313/495; 445/25

(58) Field of Classification Search ..... 313/495–497
See application file for complete search history.

(56) References Cited

U.S. PATENT DOCUMENTS 5,770,918 A * 6/1998 Kawate et al. ..... 313/495
5,807,154 A * 9/1998 Watkins ..... 445/25
6,653,769 B1 * 11/2003 Nishioka et al. ..... 313/292
6,917,155 B1 * 7/2005 Kamide et al. ..... 313/495
2002/0005693 A1 * 1/2002 Nihei et al. ..... 313/495
2002/0180342 A1 * 12/2002 Yamada et al. ..... 313/493
2004/0002276 A1 * 1/2004 Noma et al. ..... 445/2
2004/0079789 A1 * 4/2004 Hasegawa et al. ..... 228/124.6
2005/0189866 A1 * 9/2005 Kodera et al. ..... 313/495

OTHER PUBLICATIONS

Dielectric Constant Reference Guide, Clipper Controls, http://www.clippercontrols.com/info/dielectric_constants.html, pp. 1-68.*

* cited by examiner

*Primary Examiner*—Peter J Macchiarolo
*Assistant Examiner*—Anthony T Perry
(74) *Attorney, Agent, or Firm*—Robert E. Bushnell, Esq.

(57) ABSTRACT

An electron emission display device comprises: a front panel which includes a front substrate, an anode electrode formed on a surface of the front substrate, and a fluorescent layer; a rear panel which includes a rear substrate disposed facing the front substrate at a predetermined distance, electron emitters formed on the rear substrate, and at least one driving electrode that controls the emission of electrons from the electron emitters; a sealing member which seals the front and rear panels; and at least one dielectric layer included in the sealing member and having a dielectric constant less than that of the sealing member.

14 Claims, 11 Drawing Sheets

ELECTRON EMISSION DISPLAY DEVICE

CLAIM OF PRIORITY

This application makes reference to, incorporates the same herein, and claims all benefits accruing under 35 U.S.C. §119 from an application for ELECTRON EMISSION DISPLAY DEVICE earlier filed in the Korean Intellectual Property Office on Apr. 29, 2004 and there duly assigned Serial No. 10-2004-0029879.

BACKGROUND OF THE INVENTION

1. Technical Field

The present invention relates to an electron emission display device and, more particularly, to an electron emission display device which prevents a waveform distortion phenomenon and an occurrence of arcing of an output voltage, and which enables the application of a high voltage to an anode electrode.

2. Related Art

Generally, an electron emission display device is a flat display device that displays predetermined images using light generated by electrons emitted from a first substrate, which electrons collide with a fluorescent layer formed on a second substrate. The first substrate can be a hot cathode electrode or a cold cathode electrode as an electron source.

A field emission display (FED) device is an electron emission display device that uses a cold cathode electrode, and it can be a field emitter array (FEA) type, a metal-insulator-metal (MIM) type, a metal-insulator-semiconductor (MIS) type, or a surface conduction electron-emitting (SCE) type.

The FED device includes a rear panel on which a field emission device is formed, a front panel on which there is formed a fluorescent layer that generates an image using light generated by electrons emitted from the field emission device, and a sealing member that seals the front panel and the rear panel. In this case, the sealing member, an anode electrode disposed on the sealing member, and a cathode electrode-gate electrode disposed under the sealing member constitute a capacitor, and accordingly, the following formula holds:

$$Q=C\cdot V \qquad \text{[Formula 1]}$$

where V is an electric potential difference applied to the electrodes dispose on and under the sealing member, Q is an amount of charge accumulated in each of the electrodes disposed on and under the sealing member when the electric potential difference V is applied thereto, and C is the capacitance, i.e., a constant determined by the geometrical structure of the electrodes disposed on and under the sealing member.

According to the above formula, charges are accumulated on upper and lower parts of the sealing member when voltages are applied to the electrodes disposed on and under the sealing member. In this case, there is a problem in that a desired electric potential difference cannot be applied to the field emission device until sufficient charges are accumulated on the upper and lower parts of the sealing member. Also, there is a problem in that a voltage higher than a certain value is applied to the upper and lower parts of the sealing member until a sufficient amount of accumulated charges are discharged from the upper and lower parts of the sealing member when the voltage applied to the electrodes disposed on and under the sealing member is cut off. These denote a waveform distortion of an output voltage, which eventually may result in the distortion of displayed images. Also, according to the above formula, when the higher electric potential differences are applied to the electrodes disposed on and under the sealing member, the amount of charges accumulated on the upper and lower parts of the sealing member increases. This can cause an arcing of the output voltage, thereby reducing the lifetime of the FED device.

SUMMARY OF THE INVENTION

The present invention provides an electron emission display device that can prevent a distortion of image by preventing a waveform distortion phenomenon and an arcing of an output voltage as a result of reducing charges accumulated on upper and lower parts of a sealing member that seals a front panel and a rear panel.

According to an aspect of the present invention, there is provided an electron emission display device comprising: a front panel which includes a front substrate, an anode electrode formed on a surface of the front substrate, and a fluorescent layer; a rear panel which includes a rear substrate disposed to face the front substrate at a predetermined distance, electron emitters formed on the rear substrate, and at least one driving electrode that controls the emission of electrons from the electron emitters; a sealing member that seals the front and rear panels; and at least one dielectric layer having a dielectric constant less than that of the sealing member, and included in the sealing member.

According to specific embodiments of the electron emission display, the dielectric layer may be disposed between the sealing member and the front panel, or between the sealing member and the rear panel.

The fluorescent layer may be formed to expose an end of the anode electrode, and the dielectric layer may be disposed between the sealing member and the anode electrode, or between the sealing member and the driving electrode.

The dielectric layer may be a thick film. The dielectric layer may be formed of $PbO—SiO_2—B_2O_3$. The sealing member may be a sealing glass frit. The dielectric constant of the sealing glass frit may be greater than 20 F/m and less than 40 F/m, and the dielectric constant of the dielectric layer may be greater than 10 F/m and less than 20 F/m.

Another electron emission display device according to the present invention comprises: a front panel which includes a front substrate, an anode electrode formed on a surface of the front substrate, and a fluorescent layer; a rear panel which includes a rear substrate disposed facing the front substrate, cathode electrodes formed on the rear substrate, an insulating layer that covers the cathode electrodes and an entire surface of the rear substrate, gate electrodes formed to cross the cathode electrode on the insulating layer, gate holes formed through the gate electrodes and the insulating layer at a region crossing the cathode electrode and the gate electrodes, and electron emitters formed in the gate holes; a sealing member that seals the front and rear panels; and at least one dielectric layer having a dielectric constant less than that of the sealing member, and included in the sealing member.

According to a specific embodiment of the electron emission display device, the dielectric layer may be disposed between the sealing member and the front panel, or between the sealing member and the rear panel.

The fluorescent layer may be formed to expose an end of the anode electrode, and the dielectric layer may be disposed between the sealing member and the anode electrode, or between the sealing member and one of the driving electrodes and the insulating layer.

The dielectric layer may be a thick film. The dielectric layer may be formed of $PbO—SiO_2—B_2O_3$. The sealing member may be a sealing glass frit. The dielectric constant of the sealing glass frit may be greater than 20 F/m and less than 40 F/m, and the dielectric constant of the dielectric layer may be greater than 10 F/m and less than 20 F/m.

Another electron emission display device according to the present invention comprises: a front panel which includes a front substrate, an anode electrode formed on a surface of the front substrate, and a fluorescent layer; a rear panel which includes a rear substrate disposed facing the front substrate, gate electrodes formed on the rear substrate, an insulating layer that covers the gate electrodes and is formed on an entire surface of the rear substrate, cathode electrodes formed to cross the gate electrodes on the insulating layer, and electron emitters electrically connected to the cathode electrodes; a sealing member used to seal the front and rear panels; and at least one dielectric layer having a dielectric constant less than that of the sealing member, and included in the sealing member.

According to specific embodiments of the electron emission display device, the dielectric layer may be disposed between the sealing member and the front panel, or between the sealing member and the rear panel.

The fluorescent layer may be formed to expose an end of the anode electrode, and the dielectric layers may be disposed between the sealing member and the anode electrode, or between the sealing member and one of the driving electrodes and the insulating layer.

The dielectric layer may be a thick film. The dielectric layer may be formed of $PbO—SiO_2—B_2O_3$. The sealing member may be a sealing glass frit. The dielectric constant of the sealing glass frit may be greater than 20 F/m and less than 40 F/m, and the dielectric constant of the dielectric layer is greater than 10 F/m and less than 20 F/m.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in a which like reference symbols indicate the same or similar components, wherein.

DETAILED DESCRIPTION OF THE INVENTION

The present invention will now be described more fully with reference to the accompanying drawings in which exemplary embodiments of the invention are shown.

Figure 1:
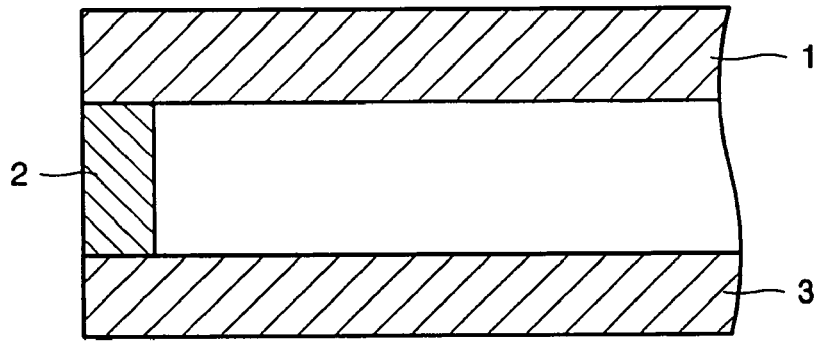
FIG. 1 is a cross-sectional view of an electron emission display device.

FIG. 1 is a cross-sectional view of an electron emission display device.

Referring to FIG. 1, an FED device includes a rear panel 3 on which a field emission device is formed, a front panel 1 on which there is formed a fluorescent layer that generates an image using light generated by electrons emitted from the field emission device, and a sealing member 2 that seals the front panel 1 and the rear panel 3. In this case, the sealing member 2, an anode electrode (not shown) disposed on the sealing member 2, and a cathode electrode-gate electrode (not shown) disposed under the sealing member 2 constitute a capacitor, and accordingly, the following formula holds.

$$Q=C\cdot V \qquad \text{[Formula 1]}$$

where V is an electric potential difference applied to the electrodes dispose on and under the sealing member 2, Q is an amount of charge accumulated in each of the electrodes disposed on and under the sealing member 2 when the electric potential difference V is applied thereto, and C is the capacitance, i.e., a constant determined by a geometrical structure of the electrodes disposed on and under the sealing member 2.

According to the above formula, charges are accumulated on upper and lower parts of the sealing member 2 when voltages are applied to the electrodes disposed on and under the sealing member 2. In this case, there is a problem in that a desired electric potential difference can not be applied to the field emission device until sufficient charges are accumulated on the upper and lower parts of the sealing member 2. Also, there is a problem in that a voltage higher than a certain value is applied to the upper and lower parts of the sealing member 2 until a sufficient amount of accumulated charges are discharged from the upper and lower parts of the sealing member 2 when the voltage applied to the electrodes disposed on and under the sealing member 2 is cut off. These denote a waveform distortion of an output voltage, which eventually may result in the distortion of displayed images. Also, according to the above formula, when the higher electric potential differences are applied to the electrodes disposed on and under the sealing member 2, the amount of charges accumulated on the upper and lower parts of the sealing member 2 increases. This can cause an arcing of the output voltage, thereby reducing the lifetime of the FED device.

Figure 2:
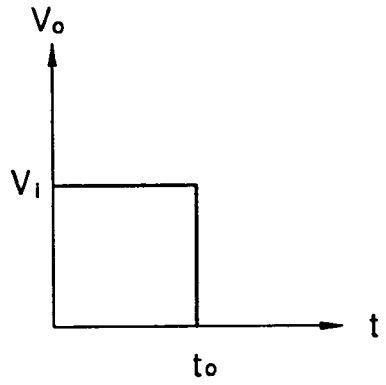
FIGS. 2 thru 4 are graphs illustrating variations of an output voltage of a circuit when the circuit includes only passive elements and does not include a capacitor (FIG. 2), and when the circuit includes capacitors of different sizes (FIGS. 3 and 4)
Figure 3:
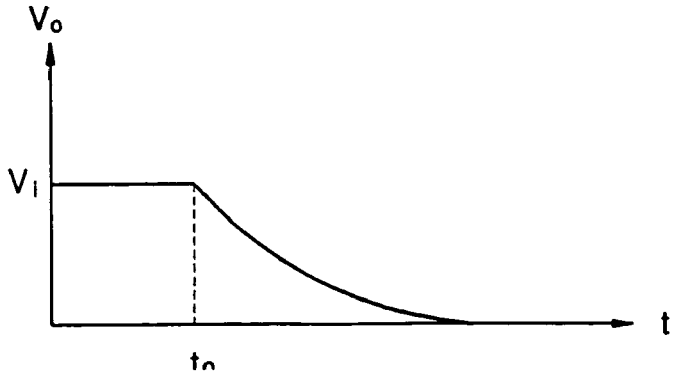
Figure 4:
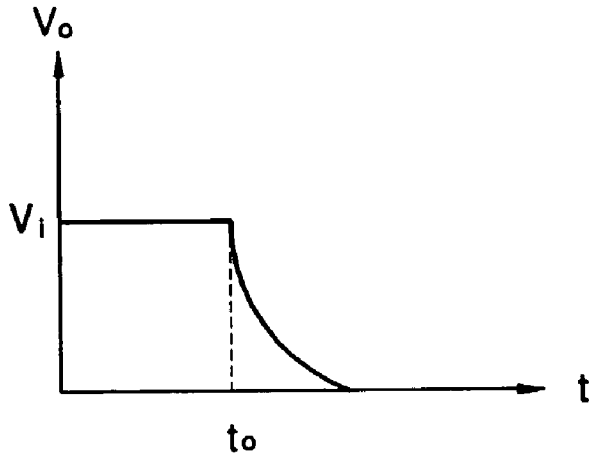

FIGS. 2 through 4 are graphs illustrating variations of an output voltage of a circuit when the circuit includes only passive elements and does not include a capacitor (FIG. 2), and when the circuit includes capacitors of different sizes (FIGS. 3 and 4).

As depicted in FIG. 2, when a constant voltage $V_i$ input to a circuit composed of only passive element resistances is cut off, an output voltage $V_o$ has a waveform identical to that of input voltage $V_i$. However, as depicted in FIGS. 3 and 4, if a capacitor is included in the above circuit, when the input voltage $V_i$ is cut off, the output voltage $V_o$ has a distorted waveform having a time constant which is equal to that of input voltage $V_i$ for a predetermined period of time, and which then drops gently to zero. The degree of distortion is greater as the capacitance of the capacitor increases. That is, the capacitance of the capacitor for the waveform shown in FIG. 3 is greater than the capacitance of the capacitor for the waveform shown in FIG. 4. This is because, according to the formula 1, as the capacitance increases, more charges are accumulated on the electrodes disposed on upper and lower parts of the capacitor at the same applied voltage, and it takes a longer time to discharge the charges accumulated on the electrodes. The same effect occurs when a voltage is applied to a capacitor. Accordingly, if the capacitance of the capacitor is reduced, the waveform distortion of the output voltage can be reduced.

Figure 5:
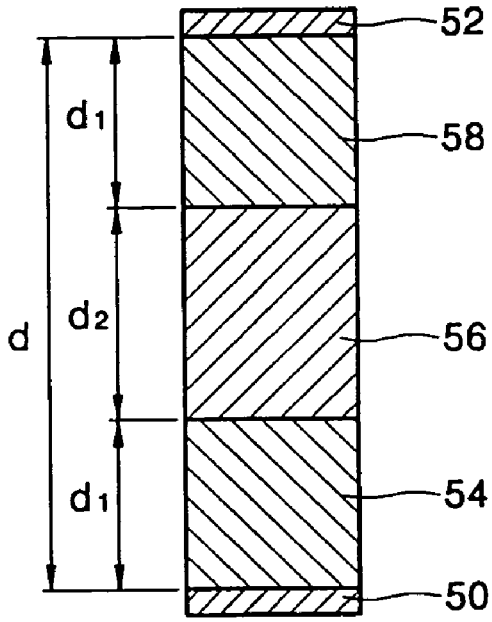
FIG. 5 is a cross-sectional view of a capacitor including dielectric layers inserted between two electrodes.
Figure 6:
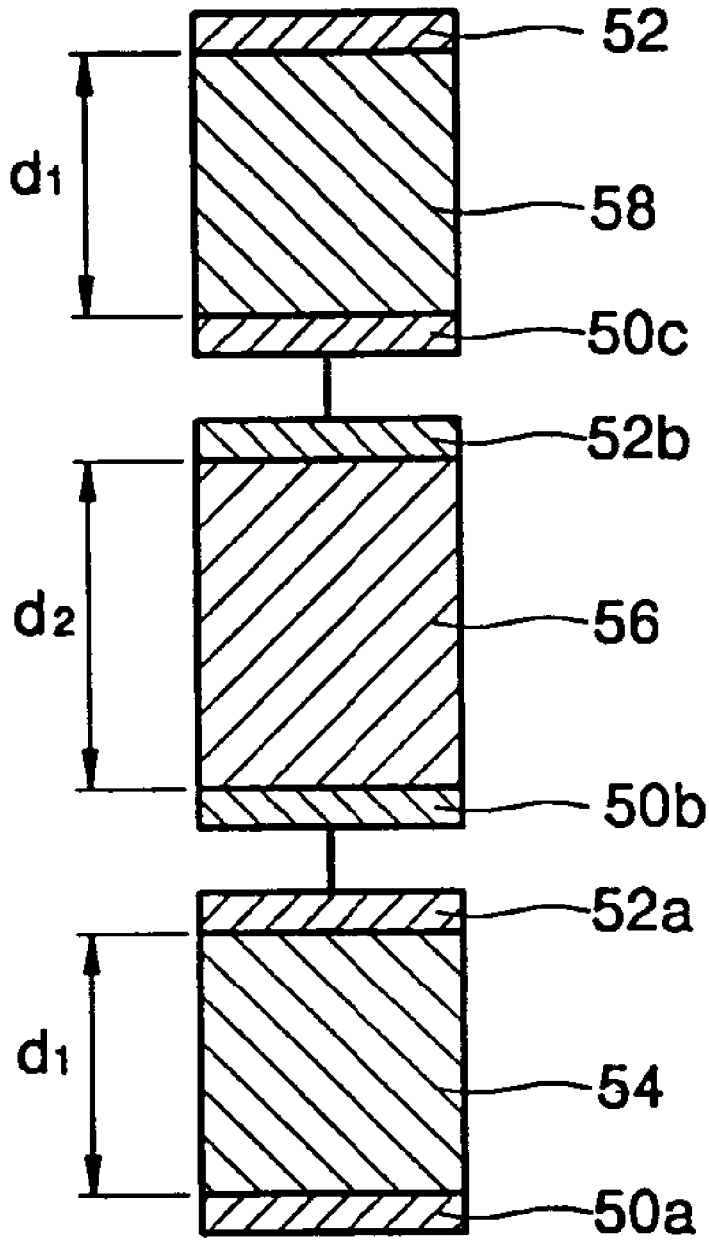
FIG. 6 is a cross-sectional view illustrating capacitors in series having a total capacitance equal to that of the capacitor of FIG. 5.

FIG. 5 is a cross-sectional view of a capacitor including dielectric layers inserted between two electrodes, and FIG. 6 is a cross-sectional view illustrating capacitors in series having a total capacitance equal to that of the capacitor of FIG. 5.

In FIG. 5, the capacitor includes dielectric layers 54, 56, and 58 inserted between two electrodes 50 and 52, and FIG. 6 is a cross-sectional view illustrating equivalent capacitors in series having a total capacitance equal to that of the capacitor of FIG. 5.

Further referring to FIG. 5, the area of each of the electrodes 50 and 52 is A. For convenience of explanation, assuming that the dielectric layers 54 and 58 directly contacting the electrodes 50 and 52 have an identical dielectric constant e1 and thickness d1, and that the dielectric layer 56 interposed between the two dielectric layers 54 and 58 has a dielectric constant e2 and a thickness d2, the capacitances of the capacitors are C1, C2, and C3 from top to the bottom in FIG. 6, and are defined in Formula 2 as follows:

$$C_1 = C_3 = \frac{A\varepsilon_1}{d_1} \qquad C_2 = \frac{A\varepsilon_2}{d_2} \qquad \text{[Formula 2]}$$

The total capacitance C' of the capacitors in FIG. 6 is determined in Formula 3 as follows:

$$\frac{1}{C''} = \frac{1}{C_1} = \frac{1}{C_2} = \frac{1}{C_1} = \frac{2}{C_1} + \frac{1}{C_2} = \frac{2d_1\varepsilon_2 + d_2\varepsilon_1}{A\varepsilon_1\varepsilon_2} \qquad \text{[Formula 3]}$$

$$C' = \frac{A\varepsilon_1\varepsilon_2}{2d_1\varepsilon_2 + d2\varepsilon_1}$$

The capacitance of the capacitor in FIG. 5 is also C'.

On the other hand, if the capacitor in FIG. 5 includes only one dielectric layer between the electrodes 50 and 52, and the dielectric layer has a dielectric constant $\in_2$ and thickness d, and $d=2d_1+d_2$, the capacitance C of the capacitor can be expressed as follows.

$$C = \frac{A\varepsilon_2}{d} = \frac{A\varepsilon_2}{2d_1 + d_2} \qquad \text{[Formula 4]}$$

At this time, if the thickness of the dielectric layer is $d_2$, and dielectric layers having dielectric constant $\in_1$ and thickness $d_1$ are inserted on and under the dielectric layer having the thickness $d_2$, a modified capacitance will be as shown as Formula 3. Therefore, the capacitance C' can have a desired value by appropriately selecting $\in_1$, $d_1$ and $d_2$. In the present invention, $\in_1$, $d_1$ and $d_2$ can be appropriately selected so that the capacitance C' is smaller than the capacitance C since a desired effect can be obtained when the capacitance C' is small. For example, to reduce the capacitance C' so that $C'=C\times 1/k$, where k is a constant greater than 1, the following conditions can be obtained from Formulae 3 and 4.

$$d_1 = \frac{(k-1)}{2}\frac{\varepsilon_1}{\varepsilon_2 - \varepsilon_1}d, \qquad d_2 = \frac{\varepsilon_2 - k_{E1}}{\varepsilon_2 - \varepsilon_1}d \qquad \text{[Formula 5]}$$

Accordingly, the capacitance C' can be reduced by 1/K times by inserting a dielectric layer having a dielectric constant smaller by 1/k times than the dielectric constant of the particular dielectric layer. The Formulae 3, 4, and 5 are derived assuming that the capacitors behave ideally.

Figure 7:
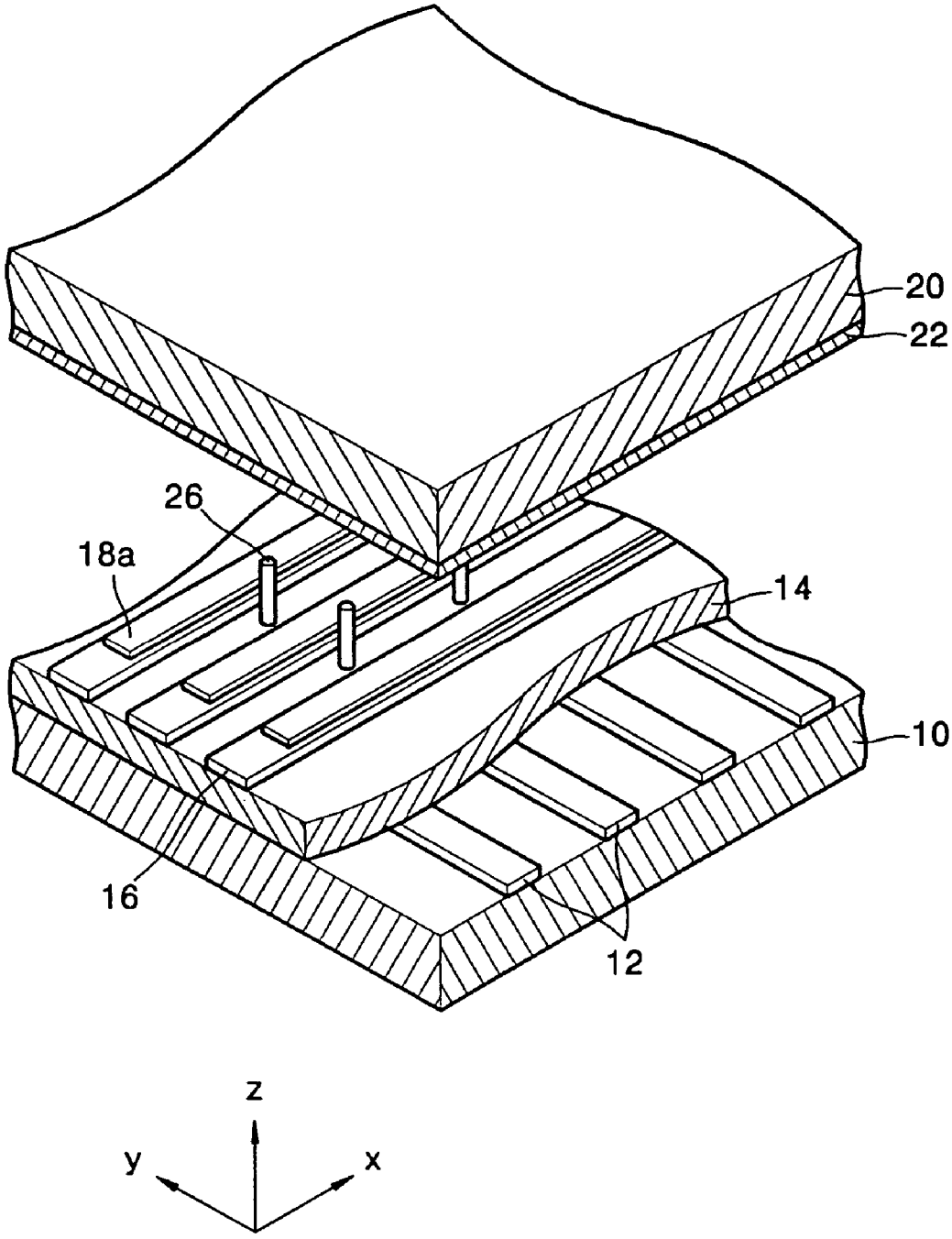
FIG. 7 is a perspective view of an under gate type electron emission display device according to an embodiment of the present invention.
Figure 8:
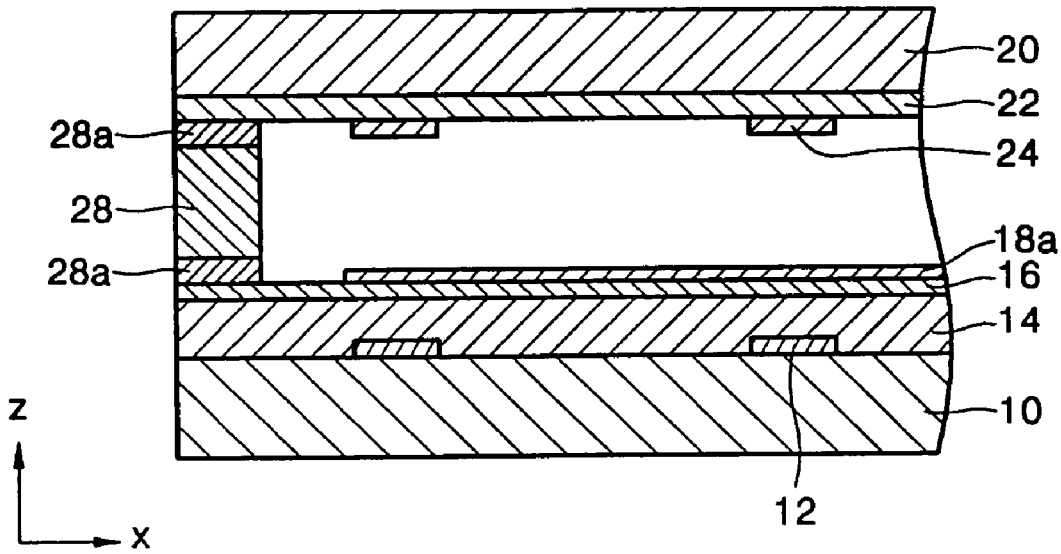
FIG. 8 is a cross-sectional view of the under gate type electron emission display device of FIG. 7.
Figure 9:
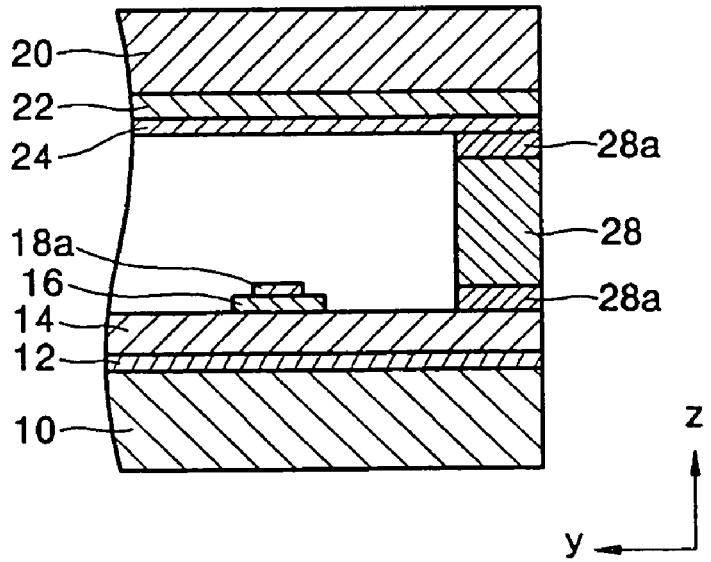
FIG. 9 is another cross-sectional view of the under gate type electron emission display device of FIG. 7.

FIG. 7 is a perspective view illustrating an under gate type electron emission display device according to a first embodiment of the present invention, while FIGS. 8 and 9 are cross-sectional views taken along the x-z plane and the y-z plane, respectively, in FIG. 7.

Referring to FIGS. 7 through 9, an electron emission display device has a structure in which a rear panel which emits electrons generated by an electron emission device included on a rear substrate 10, and a front panel which displays a predetermined image using light emitted from fluorescent layers 24 formed on a front substrate 20, are sealed with a predetermined distance which is sustained by spacers 26.

More specifically, a plurality of gate electrodes 12 with a predetermined pattern, such as a stripe pattern, are formed on the rear substrate 10, an insulating layer 14 that covers the gate electrodes 12 is formed on an entire surface of the rear substrate 10, and a plurality of cathode electrodes 16 with a predetermined pattern, such as a stripe pattern, are formed on the insulating layer 14 so as to vertically cross the gate electrodes 12. The pattern of the gate electrodes 12 and the cathode electrodes 16 is not limited to a stripe pattern.

Figure 10:
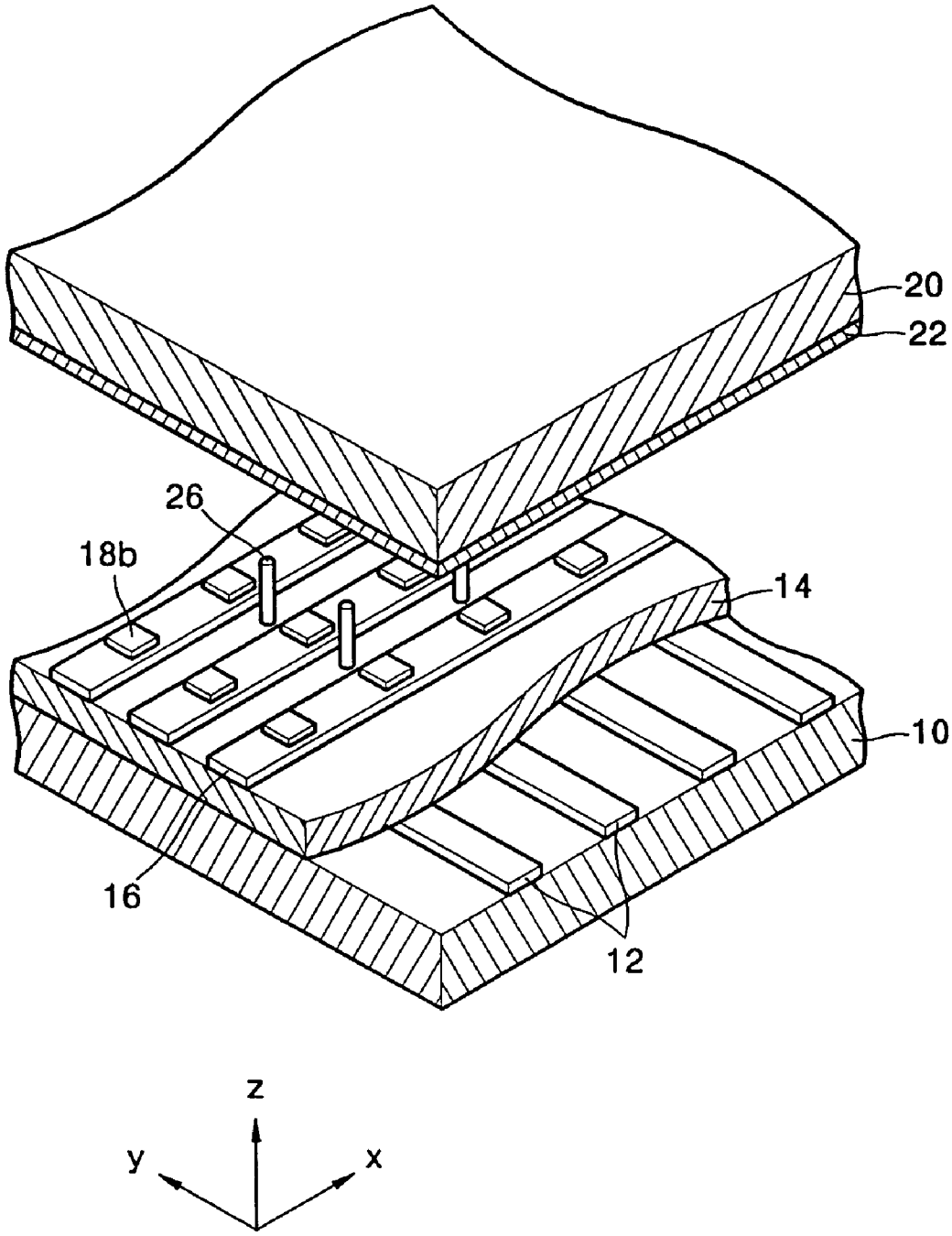
FIG. 10 is a perspective view of an under gate type electron emission display device according to another embodiment of the present invention.

Electron emitters 18*a* are formed on the cathode electrodes 16. The electron emitters 18*a* can be formed on cathode electrodes 16 in a stripe pattern identical to that of the cathode electrodes 16 as depicted in FIG. 7, or electron emitter 18*b* can be formed selectively on regions crossing the gate electrodes 12 and the cathode electrodes 16 as depicted in FIG. 10. The efficiency of electron emission can be increased by forming the electron emitters 18*a* and 18*b* on edges of the cathode electrodes 16 since a stronger electric field is formed on edges of the cathode electrodes 16.

The front substrate 20 includes a transparent anode electrode 22 and fluorescent layers 24 of red, green, and blue colors. The transparent anode electrode 22 is formed, for example, of indium tin oxide (ITO) to which a high voltage is applied in order to accelerate the electrons emitted from the electron emitters 18*a* or 18*b*. The fluorescent layers 24, which emit visible light by being excited by electrons emitted from the electron emitters 18*a* or 18*b*, can be formed in a predetermined pattern. A black matrix (not shown) for improving contrast of images can be disposed between the fluorescent layers 24.

Unlike the above description, the front panel can be formed with such a structure that the fluorescent layers of green, red, and blue color are formed with certain spaces on the front substrate 20, and an anode electrode formed of a metal thin film (such as aluminum foil) can be formed on the fluorescent layers. In this case, a black matrix for improving image contrast can be formed between the fluorescent layers. In this respect, the anode electrode formed of a metal thin film not only has a high voltage from the outside applied to it so as to accelerate the electrons, but also performs the function of securing an internal voltage of the display device and improving brightness. A transparent electrode formed of ITO can also be included on surfaces of the fluorescent layers in the above structure. The transparent electrode can cover the entire surface of the front substrate, or it can be formed in a stripe pattern. The metal thin film can be omitted, and in this case, the transparent electrode acts as the anode electrode and receives the necessary voltage for accelerating the electrons.

A predetermined gap between the rear substrate 10 and the front substrate 20 is maintained by a plurality of spacers 26.

According to the structure described above, the electron emission display device operates when a predetermined voltage is applied to the gate electrodes 12 and the cathode electrodes 16, and a high voltage required for accelerating the electrons is applied to the anode electrode 22. That is, a strong electric field is formed around the electron emitters 18*a* or 18*b* by the electric potential difference between the gate electrodes 12 and the cathode electrodes 16, and electrons are emitted from the electron emitters 18*a* or 18*b* by a quantum mechanical tunneling effect generated by the formed electric field. Then, images are displayed by light generated from the fluorescent layers 24 when electrons having high energy, induced by the voltage applied to the anode electrode 22, collide thereon.

As an operating characteristic of the electron emission display device, a space between the rear panel and the front panel must be maintained in a high vacuum state of more than 10-6 Torr. If the space is not maintained in a high vacuum state, ions are generated by collision between particles that exist in the space and the electrons emitted from the electron emitters 18*a* or 18*b*. When the ions are generated, the device can be degraded by the sputtering of the ions, and also the colliding energy of electrons (i.e., brightness of images) can be reduced since the electrons accelerated by the anode electrode 22 can lose energy by colliding with the particles existing in the space. Therefore, the space between the rear panel and the front panel is sealed with a high vacuum state using a sealing member 28, such as a sealing glass frit. At this time, dielectric layers 28*a*, having a dielectric constant less than that of the sealing member 28, are formed on and under the sealing member 28 to meet the conditions of Formula 5.

The rear panel of the electron emission display device having the above structure is formed using the following method.

As depicted in FIGS. 7 through 10, a rear substrate 10 formed of glass is prepared, and a plurality of gate electrodes 12 in a stripe pattern are formed of a transparent conductive material selected from the group consisting of ITO, IZO, or $In_2O_3$, or a metal selected from the group consisting of Mo, Ni, Ti, Cr, W, or Ag. Of course, the gate electrodes 12 can also be formed of other materials.

Next, an insulating layer 14, composed of a silicon oxide group or a silicon nitride group, is formed by screen printing a glass paste a few times on the entire surface of the rear substrate 10 to cover the gate electrodes 12.

A plurality of cathode electrodes composed of a highly conductive metal, such as Ag, are formed in a stripe pattern perpendicular to the gate electrodes 12 on the insulating layer 14.

After forming the cathode electrodes 16, electron emitters 18*a* or 18*b* are formed on a side of the cathode electrodes 16, or on a central portion or an end of the cathode electrodes 16. The electron emitters 18*a* or 18*b* can be formed of a carbon group material having a low work function, such as carbon nanotube, graphite, diamond, DLC, or $C_{60}$. After printing a thick film of a paste state carbon group material, the electron emitters 18*a* or 18*b* can be formed by patterning the thick film through processes of drying, exposing, and developing. When the electron emitters 18*a* or 18 are formed of carbon nanotubes, an erection process for disposing the carbon nanotube of electron emitters 18*a* or 18*b* in an upright or erect posture can be performed, if necessary.

After forming dielectric layers 28*a*, having an appropriate dielectric constant as described above, on an end of the rear panel and the front panel on which the anode electrode 22 and the fluorescent layers 24 are formed, the rear panel and the front panel are sealed using a sealing member 28. Sealing glass frit can be used as the sealing member 28, and in this case, a predetermined thickness of sealing glass frit in a paste state is coated on the dielectric layers 28*a* formed on an end of the rear panel using a dispensing method or a screen printing method. Moisture contained in the sealing glass frit 28 is removed through a drying process. Subsequently, the sealing of the rear panel and the front panel is completed by sintering the sealing glass frit 28 at a high temperature after aligning the rear panel and the front panel. After the completion of the sealing, the space between the rear panel and the front panel is exhausted to a high vacuum state through a predetermined exhaust hole (not shown).

In the embodiment described above, the dielectric layers can be formed between the sealing member and the rear panel, or between the sealing member and the front panel. Also, they can be formed in the sealing member, and more than two dielectric layers can be formed.

On the other hand, in the embodiment described above, the dielectric layers can be formed as a thin film or a thick film. The thin film can be formed by using a CVD method. The thick film can be formed by using a printing method, and in this case, manufacturing cost can be reduced since an inexpensive printing apparatus, not an expensive CVD apparatus, can be used. The thick film can be formed using a PbO—$SiO_2$—$B_2O_3$ group material. This can also be applied to the subsequent embodiments of the present invention.

Figure 11:
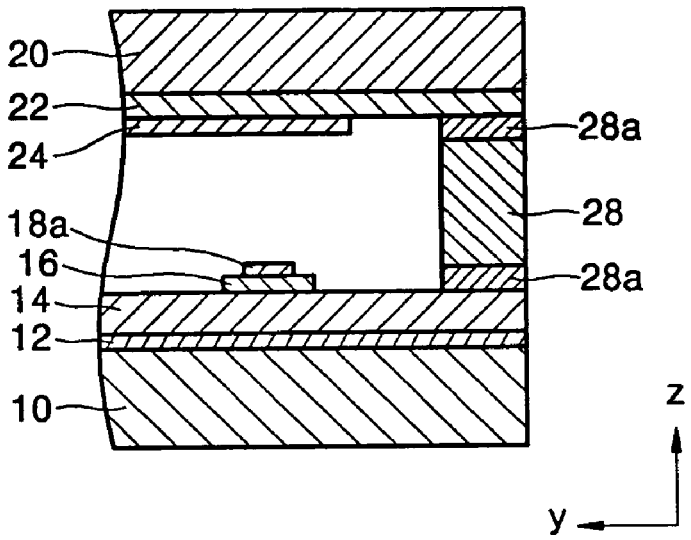
FIG. 11 is a cross-sectional view of an under gate type electron emission display device according to a second embodiment of the present invention.

FIG. 11 is a cross-sectional view of an under gate type electron emission display device according to a second embodiment of the present invention.

In this embodiment, the fluorescent layer 24, which is formed on the front panel, is not formed on an end of the front substrate 20, so that the dielectric layer 28*a* is formed on the anode electrode 22 of the front panel. The dielectric layer 28*a*, which is formed on the rear panel, is formed on an end of the cathode electrodes 16 or the insulating layer 14.

Since sealing glass frit is widely used as the sealing member of an electron emission display device, when the sealing member is formed using sealing glass frit having a dielectric constant of approximately 30 F/m, and the dielectric layers having a dielectric constant $\in_1$ of 10 F/m are formed on and under the sealing glass frit by substituting $\in_2$=30 F/m and k=2, $\in_1$=10 F/m in Formula 5, each of the thicknesses d1 of the dielectric layers on and under the sealing glass frit becomes approximately 0.25 d, and the thickness of the sealing glass frit becomes approximately 0.5 d. That is, when forming the dielectric layers on and under the sealing glass frit having a dielectric constant of $\in_1$=10 F/m, the overall capacitance is reduced to half, thereby reducing by half the amount of accumulated charges on and under the sealing glass frit. Therefore, a desired electron emission display device can be obtained.

The dielectric constant of the sealing glass frit, and that of the dielectric layer included in the sealing glass frit, will now be described.

As described above, in the present invention, it is desirable to lower the capacitance at a portion where the sealing member is located. Therefore, a sealing member and a dielectric layer having a low dielectric constant must be used to reduce the capacitance. However, in general, as the dielectric constant is reduced, the sintering temperature increases. Accordingly, if there is an upper limit of the sintering temperature, there must be a lower limit of the dielectric constant of the sealing member.

In general, the substrate of an electron emission display device is formed of glass, and the melting temperature of the glass substrate is approximately 600° C. Therefore, the sintering temperature of the glass substrate must be lower than 600° C. This denotes that there is a lower limit of the dielectric constant. Because of this limitation, in the case of the sealing glass frit, the lower limit of the dielectric constant is approximately 20 F/M, and in the case of the dielectric layer, the lower limit of the dielectric constant is approximately 10 F/m. Accordingly, it is preferable to use sealing glass frit having a dielectric constant greater than 20 F/m, and to use a dielectric layer having a dielectric constant greater than 10 F/m.

As described above, in the present invention, it is desirable to lower the capacitance at a portion where the sealing member is located, and this also denotes that there is an upper limit of the capacitance because a waveform distortion phenomenon of an output voltage and arcing occur due to the accumulation of charges on and under the sealing member as the capacitance increases.

When a sealing member is formed using sealing glass frit having a dielectric constant of 20 F/m, and dielectric layers having dielectric constants of 10 F/m are formed on and upper the sealing glass frit, the measured total capacitance is approximately equal to 2.17 F, and no waveform distortion occurs. Also, when the sealing member is formed using sealing glass frit having an increased dielectric constant of 40 F/m, and dielectric layers having dielectric constants of 20 F/m are formed on and upper the sealing glass frit, the measured total capacitance is approximately equal to 4.35 F, and waveform distortion of the output voltage occurs, but it is not large enough to affect the image. However, when the sealing glass frit and dielectric layers having greater dielectric constants than the above dielectric constants are formed, the total capacitance is increased and the waveform distortion is large enough to affect an image. Accordingly, it is desirable that the dielectric constant of the sealing glass frit be less than 40 F/m, and that the dielectric constant of the dielectric layers be less than 20 F/m.

Figure 12:
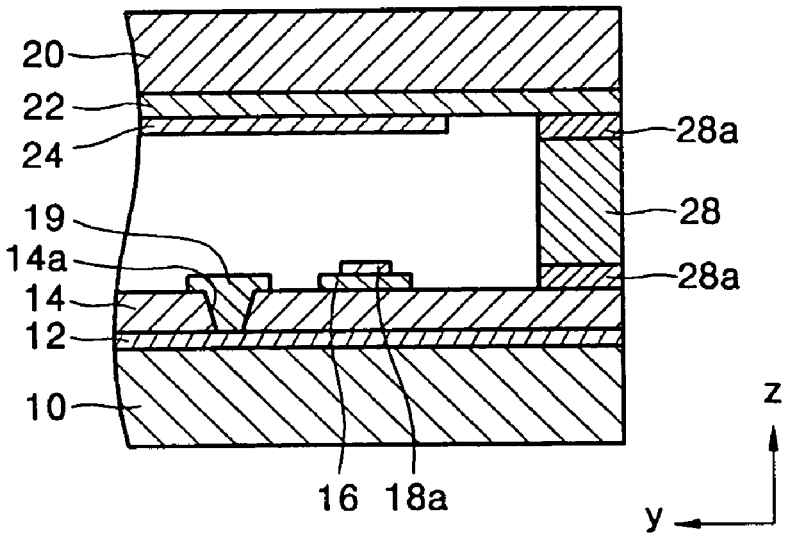
FIG. 12 is a cross-sectional view of an under gate type electron emission display device according to a third embodiment of the present invention.

FIG. 12 is a cross-sectional view of an undergate electron emission display device according to a third embodiment of the present invention.

Referring to FIG. 12, a plurality of via holes 14*a* are included in the insulating layer 14 of the rear panel, and gate islands 19 that fill the via holes 14*a* are formed on the insulating layer 14. The gate islands 19 are formed to facilitate emission of electrons from the electron emitters 18*a* or 18*b* by increasing the effect of the electric field applied by the gate electrodes 12 to the electron emitters 18*a* or 18*b*. The gate islands 19 can be formed of a conductive material and can be formed in a process simultaneously with formation of the cathode electrodes 16.

Figure 13:
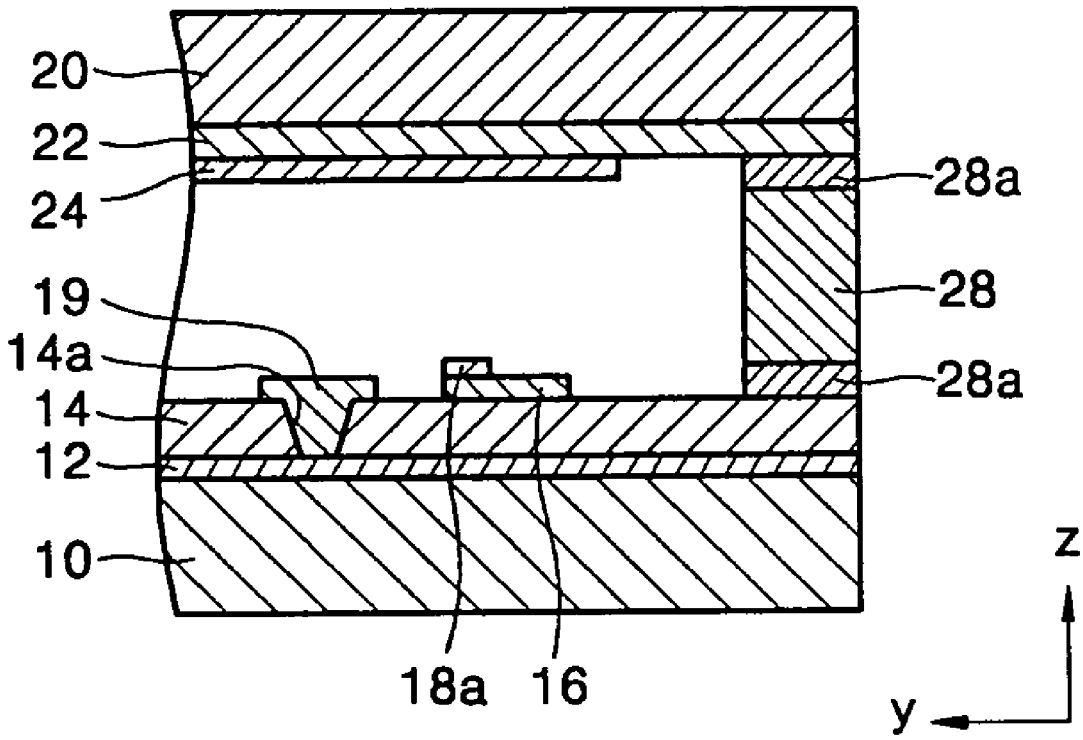
FIG. 13 is a cross-sectional view of an under gate type electron emission display device according to a fourth embodiment of the present invention.

FIG. 13 is a cross-sectional view of an under gate type electron emission display device according to a fourth embodiment of the present invention.

In FIG. 13, the electron emitters 18*a* are formed on an edge of the cathode electrodes 16. This is to increase the efficiency of electron emission by disposing the electron emitters 18*a* on an edge of the cathode electrodes 16 since a stronger electric field is formed on the edge of the cathode electrodes 16. As depicted in FIG. 10, the electron emitters 18*a* can be disposed on selective regions crossing the gate electrodes 12 and the cathode electrodes 16, and in this case also, the electron emitters 18*a* can be disposed on an edge or a side of the cathode electrodes 16.

Figure 14:
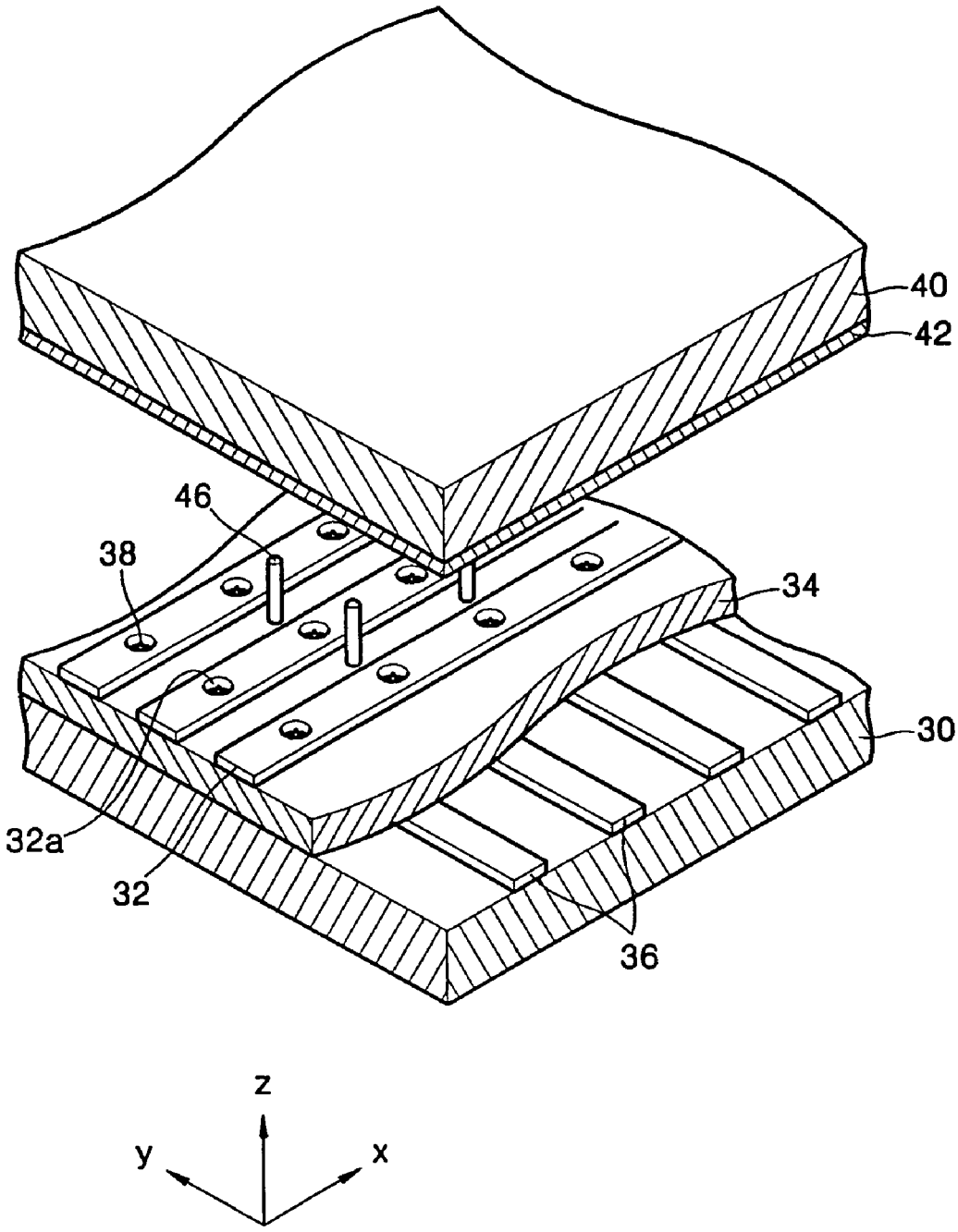
FIG. 14 is a perspective view of a top gate type electron emission display device according to a fifth embodiment of the present invention.
Figure 15:
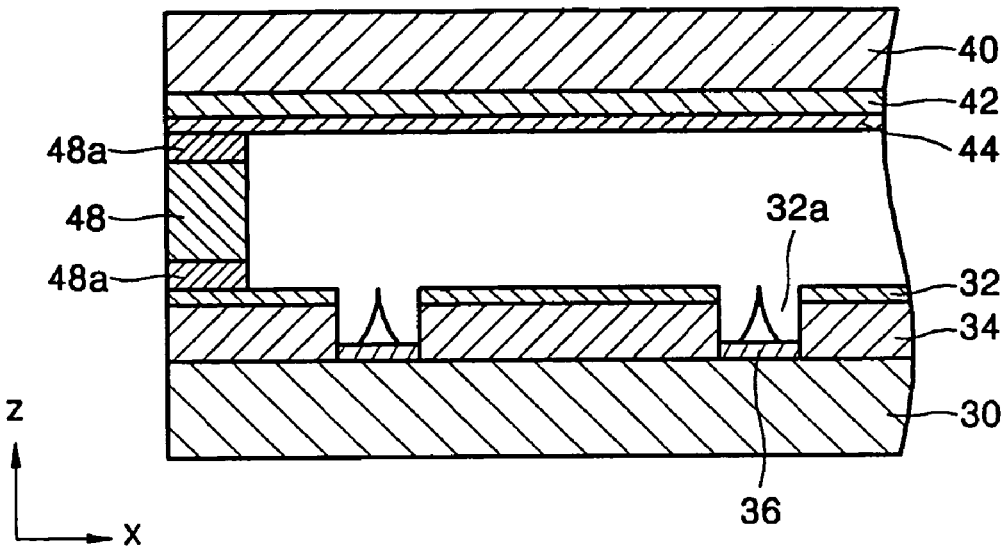
FIG. 15 is a cross-sectional view of the top gate type electron emission display device taken along the plane x-z of FIG. 14.
Figure 16:
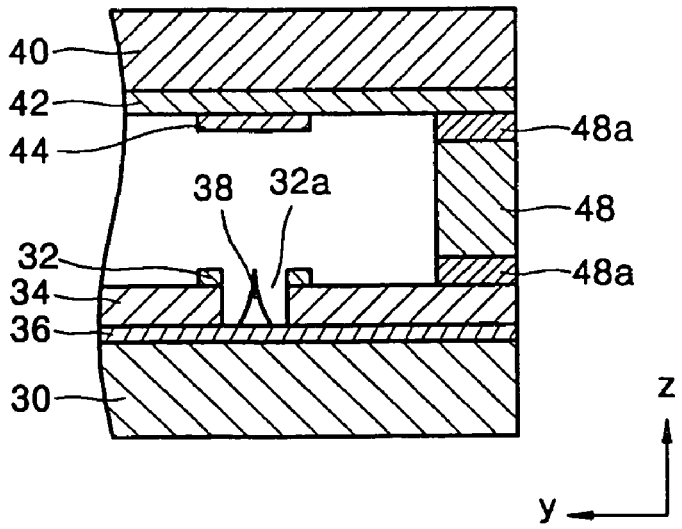
FIG. 16 is a cross-sectional view of the top gate type electron emission display device taken along the plane y-z of FIG. 14.

FIG. 14 is a perspective view of a top gate type electron emission display device according to a fifth embodiment of the present invention, while FIGS. 15 and 16 are cross-sectional view taken along the planes of x-z and y-z, respectively, of in FIG. 14.

Referring to FIGS. 14 through 16, the structure of the electron emission display device in this case is identical to that of the under gate type electron emission display device. That is, a rear panel which emits electrons generated by an electron emission device included on a rear substrate 30, and a front panel which generates a predetermined image using light emitted from fluorescent layers 44 formed on a front substrate 40, are sealed with a predetermined distance therebetween as maintained by spacers 26. The operational principle of the electron emission display device is also the same as the operational principle of the under gate type electron emission display device. The only difference is in the structure of the rear panel.

More specifically, the rear panel includes: a plurality of cathode electrodes 36 formed in a predetermined pattern, such as a stripe pattern, on the rear substrate 30; an insulating layer 34 that covers the cathode electrodes 36 formed on the entire surface of the rear substrate 30; and a plurality of gate electrodes 32 formed in a predetermined pattern, such as a stripe pattern, SO as to vertically cross the cathode electrodes 36 on the insulating layer 34. Of course, the gate electrodes 32 and the cathode electrodes 36 can be formed in patterns other than described above. Gate holes 32*a* are formed in the gate electrodes 32 and the insulating layer 34 on a portion where the gate electrodes 32 and the cathode electrodes 36 are crossing, and electron emitters 38 are formed on the cathode electrodes 36 in the gate holes 32*a*. A resistance layer (not shown) can be formed between the cathode electrodes 36 and the electron emitters 38. The electron emitters 38 can be of a cone type, such as a spindt type, or can be formed using carbon nanotube.

A method of manufacturing the rear panel of the top gate type electron emission display device will now be described.

Referring again to FIGS. 14 through 16, the cathode electrodes 36 are composed of a metal selected from the group consisting of Cr, Nb, Mo, W and Al, and are formed on the substrate 30 using a sputtering method, an evaporation deposition method, and a screen printing method, and the insulating layer 34 and the gate electrodes 32 are formed on the cathode electrodes 36 using the same methods. The resultant product is patterned through a photolithography process, and the gate holes 32*a* are formed by etching the insulating layer 34 and the gate electrodes 32 using wet etching or reactive ion etching (RIE). Next, a sacrificial layer (not shown) is formed by depositing it, via sloped deposition, on the gate electrodes 32 with a predetermined angle in a slope direction relative to the substrate 30. In this case, the sacrificial layer is not deposited on the bottom surface in the gate holes 32*a*, that is, on the cathode electrodes 36, since it is deposited by sloped deposition. After forming the sacrificial layer, the electron emitters 38 are formed by depositing, via vertical deposition, an electron emitting material toward the sacrificial layer, and on the gate holes 32*a* in a vertical direction with respect to the substrate 30. The electron emitting material is accumulated on the sacrificial layer and the cathode electrodes 36 through openings of the gate holes 32*a*. The electron emitting material is accumulated in a cone shape on the cathode electrodes 36 in the gate holes 32*a* since the probability of accumulation at the center is higher than at the edge in the gate holes 32*a*. As a result, an upper part of the gate holes 32*a*, through which the electron emitting material passes, gradually closes in a cone shape. When depositing is continued until the upper part of the gate holes 32*a* is completely closed, cone type electron emitters 38 are formed by accumulating the electron emitting material on the cathode electrodes 36. When the upper parts of the gate holes 32*a* are closed, the sacrificial layer is wet etched, and then the formation of the rear panel is completed.

When using electron emitters 38 using carbon nanotube which is not a spindt type electron emitter, the rear panel can be formed such that the cathode electrodes 36 can be formed of a transparent conductive material, such as ITO, IZO, or $In_2O_3$. After forming the insulating layer 34 that covers the cathode electrodes 36 and the entire surface of the rear substrate 30 formed of an opaque material or polyimide, the gate electrodes 32 are formed on the insulating layer 34. The gate holes 32*a* that pass through the gate electrodes 32 and the insulating layer 34 are formed, and a thick film of a paste state of carbon nanotube is printed on an entire surface of the gate electrodes 32. After sintering the paste in the gate holes 32*a* through back exposure using the opaque insulating layer 34, the electron emitters 38 can be formed by removing the remaining paste.

In the fifth embodiment, after forming dielectric layers 48*a* having a predetermined dielectric constant on ends of the rear and front panels, the panels are sealed using a sealing member 48. The sealing member 48 can be sealing glass frit. The dielectric layers 48*a* can also be included in the sealing member 48, and more than two dielectric layers can be formed.

Figure 17:
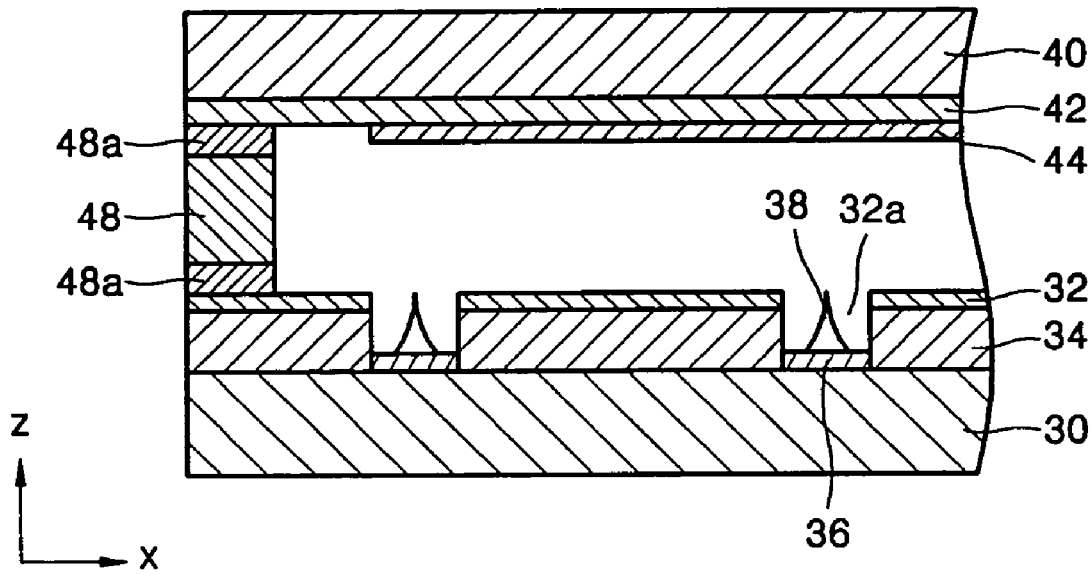
FIG. 17 is a cross-sectional view of a top gate type electron emission display device according to a sixth embodiment of the present invention.

FIG. 17 is a cross-sectional view of a top gate type electron emission display device according to a sixth embodiment of the present invention. The y-z plane of FIG. 17 is defined by the coordinates in FIG. 14.

In this embodiment, fluorescent layers 44 are formed on the front panel so as not to be on an edge thereof such that the dielectric layer 48*a* is formed on the anodes 42 of the front panel. At this point, the dielectric layers 48*a* formed on the rear panel can be formed on edges of the gate electrodes 32 or the insulating layer 34 of the rear panel.

The electron emission display device manufactured according to the present invention provides the following advantages.

First, a greater high voltage can be applied to an anode electrode since capacitance of a capacitor, which is comprised of an anode electrode, a sealing member and a cathode electrode, or of an anode electrode, a sealing member and a gate electrode, can be greatly reduced. When a higher voltage is applied to the anode electrode, electrons emitted from electron emitters with high energy can collide with fluorescent layers formed on a front panel. As a result, the brightness of images displayed by the fluorescent layer is improved.

Second, the amount of charge accumulated on the electrodes is greatly reduced since capacitance of a capacitor, which is comprised of an anode electrode, a sealing member and a cathode electrode, or of an anode electrode, a sealing member and a gate electrode, can be greatly reduced. Accordingly, waveform distortion of the output voltage can be reduced since a time required to accumulate and discharge the charges can be reduced, thereby improving the reproducibility of an image and a color.

Third, since the amount of charge accumulated on the electrodes is greatly reduced, the possibility of arcing due to an applied high voltage is reduced, thereby increasing the lifetime of the electron emission display device.

While the present invention has been particularly shown and described with reference to embodiments thereof, it will be understood by those of ordinary skill in the art that various changes in form and detail may be made therein without departing from the spirit and scope of the present invention as defined by the following claims.

What is claimed is:

1. An electron emission display device, comprising:

a front panel which includes a front substrate, an anode electrode formed on a surface of the front substrate, and a fluorescent layer;

a rear panel which includes a rear substrate disposed facing the front substrate at a predetermined distance, electron emitters formed on the rear substrate, and at least one driving electrode that controls the emission of electrons, said fluorescent layer of said front panel being formed on a surface of the anode electrode remote from the front panel and facing the rear panel;

a sealing member which seals the front and rear panels; and at least one dielectric layer included in the sealing member;

wherein the fluorescent layer is formed so as to partially cover a side of the anode electrode facing the rear panel so that portions of the anode electrode facing the rear panel are directly exposed to the rear panel, the dielectric layer being disposed between and in direct contact with the sealing member and at least one of the anode electrode and the driving electrode; and wherein the dielectric layer has a dielectric constant less than a dielectric constant of the sealing member.

2. The electron emission display device of claim 1, wherein the dielectric layer is disposed between the sealing member and at least one of the front panel and the rear panel.

3. The electron emission display device of claim 1, wherein the dielectric layer comprises a thick film.

4. The electron emission display device of claim 3, wherein the dielectric layer is formed of $PbO—SiO_2—B_2O_3$.

5. The electron emission display device of claim 1, wherein the sealing member comprises a sealing glass frit.

6. An electron emission display device, comprising:

a front panel which includes a front substrate, an anode electrode formed on a surface of the front substrate, and a fluorescent layer;

a rear panel which includes a rear substrate disposed facing the front substrate at a predetermined distance, electron emitters formed on the rear substrate, and at least one driving electrode that controls the emission of electrons;

a sealing member which seals the front and rear panels; and at least one dielectric layer included in the sealing member;

wherein the sealing member comprises a sealing glass frit; and wherein the dielectric constant of the sealing glass frit is greater than 20 F/m and less than 40 F/m, and the dielectric constant of the dielectric layer is greater than 10 F/m and less than 20 F/m.

7. An electron emission display device, comprising:

a front panel which includes a front substrate, an anode electrode formed on a surface of the front substrate, and a fluorescent layer;

a rear panel which includes a rear substrate disposed facing the front substrate, cathode electrodes formed on the rear substrate, an insulating layer that covers the cathode electrodes and an entire surface of the rear substrate, gate electrodes formed so as to cross the cathode electrode on the insulating layer, gate holes formed in the gate electrodes and the insulating layer at a region crossing the cathode electrode and the gate electrodes, and electron emitters formed in the gate holes, said fluorescent layer of said front panel being formed on a surface of the anode electrode remote from the front panel and facing the rear panel;

a sealing member which seals the front and rear panels; and at least one dielectric layer included in the sealing member;

wherein the fluorescent layer is formed so as to partially cover a side of the anode electrode facing the rear panel so that portions of the anode electrode facing the rear panel are directly exposed to the rear panel, the dielectric layer being disposed between and in direct contact with the sealing member and at least one of the anode electrode and the driving electrode;

wherein the dielectric layer has a dielectric constant which is less than a dielectric constant of the sealing member.

8. The electron emission display device of claim 7, wherein the dielectric layer is disposed between the sealing member and at least one of the front panel and the rear panel.

9. The electron emission display device of claim 7, wherein the dielectric layer comprises a thick film.

10. The electron emission display device of claim 9, wherein the dielectric layer is formed of $PbO—SiO_2—B_2O_3$.

11. The electron emission display device of claim 7, wherein the sealing member comprises a sealing glass frit.

12. An electron emission display device, comprising:

a front panel which includes a front substrate, an anode electrode formed on a surface of the front substrate, and a fluorescent layer;

a rear panel which includes a rear substrate disposed facing the front substrate, cathode electrodes formed on the rear substrate, an insulating layer that covers the cathode electrodes and an entire surface of the rear substrate, gate electrodes formed so as to cross the cathode electrode on the insulating layer, gate holes formed in the gate electrodes and the insulating layer at a region crossing the cathode electrode and the gate electrodes, and electron emitters formed in the gate holes;

a sealing member which seals the front and rear panels; and at least one dielectric layer included in the sealing member;

wherein the sealing member comprises a sealing glass frit; and wherein the dielectric constant of the sealing glass frit is greater than 20 F/m and less than 40 F/m, and the dielectric constant of the dielectric layer is greater than 10 F/m and less than 20 F/m.

13. An electron emission display device, comprising:

a front panel which includes a front substrate, an anode electrode formed on a surface of the front substrate, and a fluorescent layer;

a rear panel which includes a rear substrate disposed facing the front substrate at a predetermined distance, electron emitters formed on the rear substrate, and at least one driving electrode that controls the emission of electrons, said fluorescent layer of said front panel being formed on a surface of the anode electrode remote from the front panel and facing the rear panel;

a sealing member which seals the front and rear panels; and at least one dielectric layer included in the sealing member;

wherein the fluorescent layer is formed so as to partially cover a side of the anode electrode facing the rear panel so that portions of the anode electrode facing the rear panel are directly exposed to the rear panel, the dielectric layer being disposed between and in direct contact with the sealing member and at least one of the anode electrode and the driving electrode; and wherein the sealing member comprises a sealing glass frit having a dielectric constant greater than 20 F/m and less than 40 F/m, and said at least one dielectric layer has a dielectric constant greater than 10 F/m and less than 20 F/m.

14. An electron emission display device, comprising:

a front panel which includes a front substrate, an anode electrode formed on a surface of the front substrate, and a fluorescent layer;

a rear panel which includes a rear substrate disposed facing the front substrate, cathode electrodes formed on the rear substrate, an insulating layer that covers the cathode electrodes and an entire surface of the rear substrate, gate electrodes formed so as to cross the cathode electrode on the insulating layer, gate holes formed in the gate electrodes and the insulating layer at a region crossing the cathode electrode and the gate electrodes, and electron emitters formed in the gate holes, said fluorescent layer of said front panel being formed on a surface of the anode electrode remote from the front panel and facing the rear panel;

a sealing member which seals the front and rear panels; and at least one dielectric layer included in the sealing member;

wherein the fluorescent layer is formed so as to partially cover a side of the anode electrode facing the rear panel so that portions of the anode electrode facing the rear panel are directly exposed to the rear panel, the dielectric layer being disposed between and in direct contact with the sealing member and at least one of the anode electrode and the driving electrode; and wherein the sealing member comprises a sealing glass frit having a dielectric constant greater than 20 F/m and less than 40 F/m, and said at least one dielectric layer has a dielectric constant greater than 10 F/m and less than 20 F/m.

* * * * *